US006102837A

United States Patent [19]

Hubbard

[11] Patent Number: 6,102,837

[45] Date of Patent: Aug. 15, 2000

[54] ROPE EXERCISE DEVICE

[75] Inventor: David A. Hubbard, Marietta, Ga.

[73] Assignee: Vital Visions, Inc., Atlanta, Ga.

[21] Appl. No.: 08/695,606

[22] Filed: Aug. 12, 1996

[51] Int. Cl.[7] ..... A63B 21/018

[52] U.S. Cl. ..... 482/120; 482/114

[58] Field of Search ..... 482/120, 114, 482/118, 119

[56] References Cited

U.S. PATENT DOCUMENTS

| | | | |
|---|---|---|---|
| 785,019 | 3/1905 | Parker | 482/120 X |
| 3,197,204 | 7/1965 | Holkesvick . | |
| 3,217,840 | 11/1965 | Holkesvick . | |
| 3,411,776 | 11/1968 | Holkesvick et al. . | |
| 3,462,142 | 8/1969 | Sterndale . | |
| 3,472,510 | 10/1969 | Holkesvick . | |
| 3,506,262 | 4/1970 | Wade . | |
| 3,510,132 | 5/1970 | Holkesvick . | |
| 3,519,269 | 7/1970 | Howlett et al. . | |
| 3,532,189 | 10/1970 | Wade . | |
| 3,591,174 | 7/1971 | Silberman . | |
| 3,608,900 | 9/1971 | Welch . | |
| 3,614,098 | 10/1971 | Carr . | |
| 3,650,531 | 3/1972 | Pridham . | |
| 3,656,745 | 4/1972 | Holkesvick . | |
| 3,717,339 | 2/1973 | Holkesvick et al. . | |
| 3,782,722 | 1/1974 | Webb . | |
| 4,027,876 | 6/1977 | Johnson . | |
| 4,040,627 | 8/1977 | Useldinger . | |
| 4,294,446 | 10/1981 | Moore . | |
| 4,311,218 | 1/1982 | Steffen . | |
| 4,343,466 | 8/1982 | Evans . | |
| 4,560,160 | 12/1985 | Smith . | |
| 5,193,252 | 3/1993 | Svehaug . | |
| 5,352,172 | 10/1994 | Suzaki . | |

OTHER PUBLICATIONS

REI (Recreational Equipment, Inc.) Spring '96 Catalog, p. 41, Item G, "Black Diamond Super–8 Delay Device ".

*Primary Examiner*—Richard J. Apley
*Assistant Examiner*—William LaMarca
*Attorney, Agent, or Firm*—Needle & Rosenberg, P.C.

[57] ABSTRACT

A rope pull exercising device in which the rope follows a tortuous path around a figure eight braking bar of the type used conventionally in rock climbing. The rope threads through one of the rings of the figure eight bar at least once and around the connecting region that joins through the rings. Mounting structure secures the second ring to a stationary object such as, for example, a door frame.

9 Claims, 1 Drawing Sheet

ROPE EXERCISE DEVICE

FIELD OF THE INVENTION

The present invention relates to friction resistant exercise devices, and more particularly to rope exercise devices in which exercise resistance is provided by friction between a rope and a rigid object about which the rope is wound.

BACKGROUND OF THE INVENTION

Many frictionally resistant rope exercise devices have been devised over the years. In general, these devices comprise a rigid object about which a rope is wound. Handles are attached to each end of the rope. A person exercises with the device by grasping the handle on one end of the rope and pulling the rope so that it winds around the object. Friction between the rope and the rigid object inhibits travel of the rope, and provides exercise resistance. Resistance can be varied by increasing or decreasing the number of turns of the rope around the object. An exerciser can also vary the resistance by pinching or holding the free end of the rope, and by loosening or tightening this hold on the free end of the rope.

In some frictionally resistant exercise devices one handle is secured to each end of the rope, and a person using the device grasps the handles at both ends of the rope during an exercise routine. To exercise with such devices a person alternately pulls each of the handles. Because the exerciser always has both handles in his hands at all times, and thus because he is always holding the free end of the rope, it is relatively easy in these type of devices to vary the resistance either by holding back or easing up on the free end of the rope while exercising. The exerciser can also vary the resistance by increasing the number of turns that the rope winds around the object. Other exercise devices are constructed with dual handles at each end of the rope so that a person using the device grasps only one end of the rope at a time. Using both hands the person grasps both handles at one end of the rope and pulls. After pulling the rope through the object in one direction, the person releases the handles, grasps the handles on the other end of the rope with both hands, and pulls the rope back through the object. In this type of device the exerciser most often varies the exercise resistance by varying the number of turns of the rope around the object. It is difficult, while grasping the handles on one end of the rope, to vary resistance by holding the free end of the rope. Accordingly, the object about which a rope is wound in this type of device is often large and complex to accommodate the desired number of turns, and to increase the ease with which one can vary the number of turns.

Objects used in many rope exercise devices contain two guides that align the rope as it enters and exits the object. These guides add weight and complexity to the object. The guides also can contribute unintentionally to the tension of the rope when the rope is not pulled directly through the guides, as occurs when a person using the device pulls the rope in varying directions for exercise purposes. In other devices the rope must travel over or through points which undesirably pinch, crimp, or twist the rope, thereby causing premature failure of the rope.

Because of the complexity of many devices one is limited with respect to where and how he or she can mount the device. It is desirable, however, to mount the device at varying locations to accommodate the exercise needs of a consumer.

SUMMARY OF THE INVENTION

The present invention provides a rope pull exercising device in which the rope follows a tortuous path around a figure eight braking bar of the type used conventionally in rock climbing. The rope threads through one of the rings of the figure eight bar at least once and drapes smoothly over an intermediate region that joins the rings. Mounting structure secures the second ring to a stationary object such as, for example, a door frame.

Two handles are secured to each end of the rope. The handles are specially configured to allow a person using the device to grip, with both hands, the handles at one end of the rope while also holding the free end of the rope to vary resistance. In particular, the handles feature grooves in which the free end of the rope can be positioned, and through which the free end of the rope can slide. Because the free end of the rope slides through these grooves a user of the device can hold the free end of the rope within his grasp while gripping the dual handles and pulling the rope through the first ring.

The present invention also provides a structure to mount the device to a stationary object. Particularly, such structure may comprise a continuous flexible strap that is tied to the second ring of the figure eight bar. A region of the strap is stiffened. By dropping the strap over a door so that the stiffened region is separated from the figure eight bar by the door, and subsequently closing the door, a person is able to mount the device to the door because the stiffened region cannot slide though the crevice between the door and the door casing. Because the device can be mounted to a door it can be used in practically any building, whenever a consumer has the need or desire to exercise. Because of its small and compact size, the devise is particularly suited for travelers.

It is an object of this invention, therefore, to provide a friction resistant rope exercise device.

It is also an object of the present invention to provide a rope exercise device in which a user of the device can pull one end of the rope through the device while grasping the other end of the ropes for resistance.

It is another object of this invention to provide a rope exercise device that can be mounted to a door.

A still further object of the invention is to provide a rope exercise device that is elegantly simple in structure and lightweight.

Another object of this invention is to reduce the wear of a rope used with the exercise device.

It is yet another object of this invention to provide a rope exercise devise that omits guides for the rope.

Other objects, features and advantages of the present invention will become apparent from the remainder of this document.

DETAILED DESCRIPTION

Figure 1:
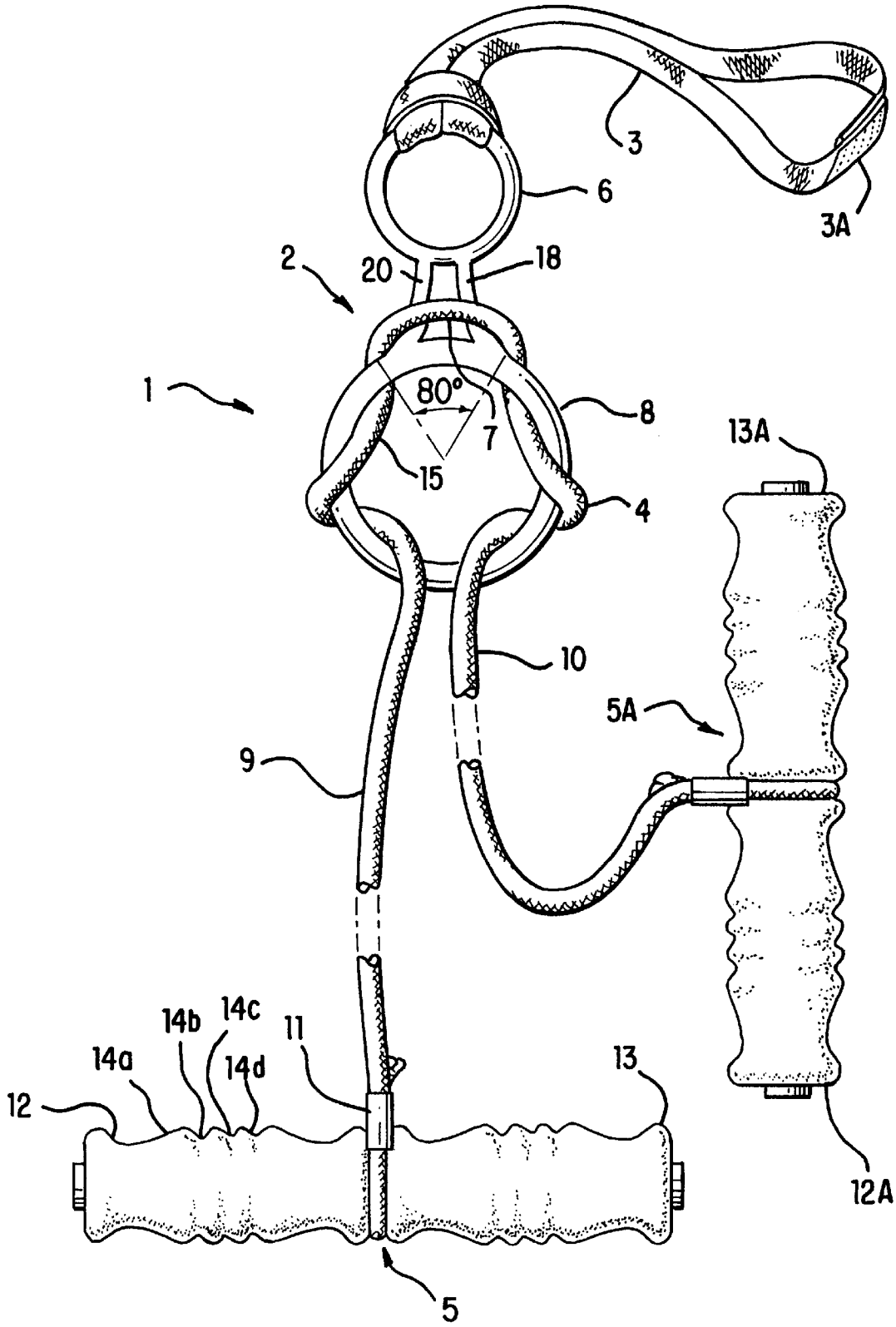
FIG. 1 is a flat perspective view of a device showing the various aspects of the invention.

FIG. 1 shows a rope exercise device 1 comprising elements that carry out the various aspects of this invention. The elements shown correspond to one particular embodiment of this invention, and other embodiments are within the scope and coverage of the invention. FIG. 1 shows a rigid object 2 about which a rope 4 is wound. Rigid object 2 is comprised of two rings 6 and 8 that are joined at their edges by an intermediate region 7 to form an object substantially in the shape of a figure eight.

Rigid object 2 may be formed from any strong and rigid material including but not limited to wood, metal alloys, and organic polymers. Besides being strong and rigid, the material chosen for the rigid object 2 also should be capable of withstanding the heat of friction that is generated between the rope and the rigid object during intense use of the device. The surface of the rigid object 2 is preferably smooth to allow the surface of a rope to pass over the surface of the rigid object smoothly without damaging the rope or causing the rope to snag on a rough spot on the surface of the object during an exercise routine.

Exercise devise 1 further comprises a rope 4 that winds around rigid object 2. While a rope is shown in FIG. 1, other cord-like objects are also suitable for use in the invention, including but not limited to cables, straps, wires, and other elongated, strong, and flexible objects. Moreover, many types of materials are suitable for construction of the rope or other cord-like material, including cellulosic materials, polymeric materials and metals. For simplicity, the term "line," when used in this specification and the claims, shall refer to all ropes and other cord-like objects that are suitable for use in the present invention regardless of the material from which they are made.

Rope 4 has two end regions 9 and 10, and an intermediate region 15. Intermediate region 15 spirals around ring 8 twice, once on each of the opposing sides of ring 8. The end regions of rope 4 drape over the bottom of ring 8 from beneath the opposing spirals, and extend away from rigid object 2. At the top of ring 8 rope 4 drapes over intermediate region 7 from beneath the opposing spirals, thereby joining the two ends of the rope and allowing the spirals on the opposing sides of ring 8 to communicate.

Intermediate region 7 is formed of two substantially parallel rounded bars 18 and 20, of substantially the same diameter as the bars from which rods 6 and 8 are formed, bent inwardly slightly and shaped to form smooth intimate bonds with rings 6 and 8, to accommodate the smooth passage of rope 4 as it travels across the intermediate region during an exercise routine. The outer edges of bars 18 and 20 are secured to ring 8 approximately 60 to 95 degrees apart along the exterior of ring 8. The spacing of bars 18 and 20 is sufficient to maintain the configurational stability of rope 4 along its desired path around ring 8, and also to reduce undesirable pinching of the rope at the intersection of intermediate region 7 and ring 8 that might otherwise cause destructive crimping or twisting of the fibers of which rope 4 is comprised, and resultant premature failure of rope 4. The maximum and minimum spacing of the bars by which the device will work effectively vary depending upon the respective diameters of bars 18 and 20 and rope 4. Typically, the exteriors of bars 18 and 20 are separated by about 75 to 85 degrees along the circumference of ring 8.

Means to mount the device to a stationary object comprise a strap 3, also shown in FIG. 1. Strap 3 is made from a flat length of flexible material. Strap 3 is continuous, meaning that its ends have been secured together to form a circuitous flexible object. As with rope 4, strap 3 can be made from any suitable strong and flexible material. In FIG. 1 strap 3 has been looped through itself around one side of ring 6 to secure the strap to the device.

A segment of strap 3 is stiffer than the remainder of strap 3, and is identified as stiffened region 3A in FIG. 1. Stiffened region 3A is formed at the overlap of the two ends of the strap by intensively sewing the two ends of the strap together. The stiffened region can, of course, be formed in many other ways depending upon the type of material that is used for the strap.

Stiffened region 3A renders strap 3 particularly suitable for mounting the exercise device to a closed door. Because the strap is flat the device can be secured to a door jam by, for example, positioning the stiffened region on one side of a door, draping the exercise device over the top of the door, and closing the door so that the stiffened region is separated from the remainder of the device by the door jam.

After the device has been mounted to a door gravitational forces encourage the device initially to become aligned upright, with ring 8 aligned directly below ring 6. The loose interaction between ring 6 and strap 3 allows ring 6 to slide through strap 3 to achieve such upright alignment. Pulling either end of the rope downward substantially reinforces such upright alignment, due to the frictional interaction between rope 4 and the points at which rope 4 contacts rigid object 2, and the resultant net direction of forces applied to the rigid object.

Pulling either end of rope 4 away from rigid object 2 also stabilizes the configuration of the rope as it winds around rigid object 2. The loose interaction between strap 3 and ring 6 (which allows the rigid object to achieve optimal alignment), combined with the frictional interaction between rope 4 and rigid object 2, causes the configurational stability of the rope relative to the rigid object. The configurational stability of the rope in turn eliminates the need for guides to align the rope with the rigid object. By eliminating the guides the devise is able to accommodate an increased number of exercise routines. In particular, the flexibility of the mounting means, combined with the omission of guides from the rigid object, allows a person to pull the rope in virtually any direction.

After the device has been mounted a person can exercise with the device by alternately pulling on end sections 9 and 10 of rope 4. Exercise resistance is provided by the frictional engagement between rope 4 and the points at which it contacts ring 8 and intermediate region 7. Frictional resistance can be varied by altering the number of spirals that the rope turns around ring 8. One can alter the number of spirals by taking one of the end regions 9 or 10 of rope 4 and inserting it through the interior of ring 8. Inserting the end of the rope through the backside of the ring adds a spiral, while inserting the end of the rope through the front side of the ring eliminates a spiral. One can also alter the number of spirals by pinching the rope where it drapes over intermediate region 7. By pulling the pinched portion of the rope through the front opening of ring 8 and over the back of ring 6, and retightening the rope, one increases the number of spirals by two, one on each side of ring 8. To reverse the process, and to decrease by two the number of turns of the rope around ring 8, one pinches the rope where it drapes over intermediate region 7, pulls the rope over the front and top of ring 6, and retightens the rope.

FIG. 1 further shows two handle units 5 and 5A that are tied to rope ends 9 and 10 respectively. Handle unit 5 comprises two opposed handle members 12 and 13. Handle unit 5A is substantially similar to handle unit 5, and similarly comprises two opposed handle members 12A and 13A. Opposed handle members 12 and 13 are joined at juncture 11, which is also the point at which rope end 9 is tied to handle unit 5. In a suitable construction of handle unit 5, hollow cores extend longitudinally through handle members 12 and 13. A tube or other elongated member is inserted through handle members 12 and 13 and capped at the ends to retain handle members 12 and 13. The tube serves to join the handle members and to provide the necessary structure for handle unit 5. PVC tubing is particularly useful in such an application because of its light weight, strength, and structural rigidity. Other types of tubing and materials can, of course, also be used. Rope end 9 is tied directly to the tube, at juncture 11.

Handle members 12 and 13 each have a plurality of grooves that traverse the circumference of the handle member. Handle member 12 has three grooves 14*a*, 14*b*, and 14*c*. The width of each of grooves 14*a*, 14*b*, and 14*c* corresponds generally to the diameter of rope 4. Thus, when a person desires to exercise by pulling rope end 9 he can place rope end 10 into one of the grooves of either handle member 12 or 13, grip handle members 12 and 13 with both hands, and at the same time grasp rope end 10 by pressing rope end 10 against the handle member. The handle members can optionally be formed from a compressible sponge-like material. Many suitable natural and synthetic materials are available for such use, and are well known to those of ordinary skill in the art. Compressible materials enable a person to compress the handle member to more readily grasp rope 10 and press rope 10 into the handle member while exercising with the device. During an exercise routine the person can grasp handle members 12 and 13 at the same time, and draw rope 4 through the rigid object 2 by pulling the handle unit away from the device. When rope end 10 is placed into any of the grooves of handle members 12 or 13, one can adjust the exercise resistance by varying the pressure that one exerts against rope end 10 as it slides through the groove.

There have been thus disclosed several embodiments of a novel and effective friction resistant exercise device. The foregoing is provided for purposes of illustrating, explaining, and describing embodiments of the present invention. Modifications and adaptations to theses embodiments will be apparent to those skilled in the art and may be made without departing from the scope and spirit of this invention.

What is claimed is:

1. An improved rope exercise device of the type wherein a line having firs and second ends spirals around a rigid object, and wherein two opposed handles are secured to the first end of the line, the improvement comprising: an outer surface on said handles formed from a compressible material and having a plurality of grooves radially extending about the outer surface, each groove having a dimension corresponding generally to the diameter of said line so that said line can be received therein, allowing a user to pull against resistance created by the line received in at least one of the grooves and spiraled around the object.

2. The exercise device of claim 1, wherein a. the rigid object comprises first and second rings joined at an intermediate region; and b. the line spirals around the first ring at least once and drapes over the intermediate region and wherein the device further comprises structure for securing the second ring to a stationary object.

3. The exercise device of claim 2 wherein the first and second rings are circular.

4. The exercise device of claim 2 wherein the rigid object consists essentially of first and second rings joined at an intermediate region.

5. The exercise device of claim 2 wherein the exterior of the intermediate region joins the exterior of the first ring at two points approximately 60 to 95 degrees apart.

6. The exercise device of claim 5 wherein the exterior of the intermediate region joins the exterior of the first ring at two points approximately 75 to 85 degrees apart.

7. The exercise device of claim 2 wherein the structure for securing the second ring to a stationary object comprises a continuous strap having a stiffened region secured to the second ring.

8. The exercise device of claim 4 wherein the structure for securing the second ring to a stationary object comprises a continuous strap having a stiffened region secured to the second ring.

9. The exercise device of claim 1 wherein a width of the groove roughly corresponds to the diameter of the line.

* * * * *